US011641054B2

(12) United States Patent
Huang et al.

(10) Patent No.: US 11,641,054 B2
(45) Date of Patent: May 2, 2023

(54) COMMUNICATION DEVICE

(71) Applicant: ASUSTeK COMPUTER INC., Taipei (TW)

(72) Inventors: Pei-Chuan Huang, Taipei (TW); Chia-Ho Lin, Taipei (TW); Pin-Tang Chiu, Taipei (TW); Ling Tien, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 102 days.

(21) Appl. No.: 16/919,365

(22) Filed: Jul. 2, 2020

(65) Prior Publication Data

US 2021/0013584 A1 Jan. 14, 2021

(30) Foreign Application Priority Data

Jul. 9, 2019 (TW) ..... 108124163

(51) Int. Cl.
*H01Q 1/22* (2006.01)
*H01Q 1/42* (2006.01)

(52) U.S. Cl.
CPC ..... *H01Q 1/2266* (2013.01); *H01Q 1/421* (2013.01)

(58) Field of Classification Search
CPC ..... H01Q 1/2266; H01Q 1/421; H01Q 1/243; H01Q 1/36; H01Q 1/38; H01Q 1/44; H01Q 1/50; H01Q 5/307; H01Q 13/106; H01Q 21/28; H01Q 5/314; H01Q 5/371; H01Q 7/00; H01Q 9/0421; H01Q 9/42; H01Q 1/48; H01Q 13/10; H01Q 1/22; H01Q 1/24; H01Q 5/35; H01Q 1/242; H01Q 1/521; H01Q 5/328; H01Q 9/0407; H01Q 5/10; H01Q 5/28; H01Q 5/50; H01Q 1/2258; H01Q 5/20; H01Q 9/04; H01Q 9/40; H01Q 1/42; H01Q 21/30; H01Q 1/241; H01Q 9/30; H01Q 5/30; H01Q 5/335; H01Q 1/273; H01Q 21/08; H01Q 5/364; H01Q 5/378; H01Q 5/40; H01Q 9/285; H01Q 9/045; H01Q 21/0087; H01Q 5/385; H01Q 9/0414; H01Q 1/523; H01Q 21/00; H01Q 9/28; H01Q 23/00; H01Q 1/2283; H01Q 1/245; H01Q 21/0075; H01Q 5/357; H01Q 13/18; H01Q 21/064; H01Q 21/24; H01Q 1/2291; H01Q 1/244; H01Q 1/526; H01Q 13/103; H01Q 13/16; H01Q 21/06;
(Continued)

(56) References Cited

U.S. PATENT DOCUMENTS 10,439,270 B2 10/2019 Wu et al.
2018/0233807 A1* 8/2018 Ma ..... H01Q 21/0075
2018/0342791 A1* 11/2018 Wu ..... H01Q 1/36

FOREIGN PATENT DOCUMENTS

TW M509447 U 9/2015
TW I599312 B 9/2017
(Continued)

*Primary Examiner* — Andrea Lindgren Baltzell
(74) *Attorney, Agent, or Firm* — McClure, Qualey & Rodack, LLP

(57) ABSTRACT

A communication device is provided here. The communication device includes a metal cover, a first radiator, and a second radiator. The metal cover includes a slot. The first radiator overlaps the slot in a first direction. A portion of the second radiator overlaps a portion of the first radiator in the first direction.

10 Claims, 3 Drawing Sheets

(58) Field of Classification Search
CPC ..... H01Q 5/321; H01Q 9/0457; H01Q 1/52; H01Q 13/02; H01Q 9/14; H01Q 9/145; H01Q 1/2208; H01Q 1/3233; H01Q 1/525; H01Q 13/085; H01Q 21/0006; H01Q 21/065; H01Q 25/001; H01Q 25/005; H01Q 3/24; H01Q 3/30; H01Q 3/36; H01Q 7/005; H01Q 9/32; H01Q 1/02; H01Q 1/12; H01Q 1/32; H01Q 13/06; H01Q 13/08; H01Q 21/0037; H01Q 21/067; H01Q 3/26; H01Q 9/0435; H01Q 9/0442; H01Q 9/0485; H01Q 9/16; H01Q 9/26; H01Q 1/27; H01Q 1/40; H01Q 21/0025; H01Q 21/12; H01Q 21/20; H01Q 21/205; H01Q 25/00; H01Q 3/2623; H01Q 9/0471; H01Q 1/084; H01Q 1/1221; H01Q 1/125; H01Q 1/246; H01Q 1/3275; H01Q 1/46; H01Q 15/008; H01Q 21/005; H01Q 21/29; H01Q 5/25; H01Q 7/06; H01Q 9/18; H01Q 9/265; H01Q 1/06; H01Q 1/1207; H01Q 1/2225; H01Q 1/2275; H01Q 1/3216; H01Q 1/3291; H01Q 11/08; H01Q 15/14; H01Q 21/061; H01Q 21/26; H01Q 3/00; H01Q 5/00; H01Q 5/42; H01Q 9/0464; H01Q 9/36

See application file for complete search history.

(56) References Cited

FOREIGN PATENT DOCUMENTS

| | | |
|---|---|---|
| TW | I608653 B | 12/2017 |
| TW | I637558 B | 10/2018 |

* cited by examiner

COMMUNICATION DEVICE

CROSS-REFERENCE TO RELATED APPLICATION

This application claims the priority benefit of Taiwan application serial No. 108124163, filed on Jul. 9, 2019. The entirety of the above-mentioned patent applications are hereby incorporated by references herein and made a part of specification.

BACKGROUND OF THE INVENTION

Field of the Invention

The invention relates to a communication device and, more particularly, to a communication device with an antenna.

Description of the Related Art

Conventionally, if an antenna of an electronic device is affected by metal (such as a back cover, a frame or a casing), the radiation efficiency is low, and the radiation pattern is poor. Antenna signals may be disconnected. As a result, a clear zone needs to be configured for the radiating of the antenna. For example, a slot of a certain size, length, and location needs to be configured at a metal casing. However, it affects the appearance of the whole electronic device.

BRIEF SUMMARY OF THE INVENTION

A communication device includes a metal back cover, a first radiator, and a second radiator. The metal back cover includes a slot. The first radiator and a slot overlap at a first direction. A portion of the second radiator and a portion of the second radiator overlap at the first direction.

DETAILED DESCRIPTION OF THE EMBODIMENTS

These and other features, aspects and advantages of the present invention will become better understood with regard to the following description, appended claims, and accompanying drawings. In figures, the same number denotes the same or similar components or steps.

Figure 1:
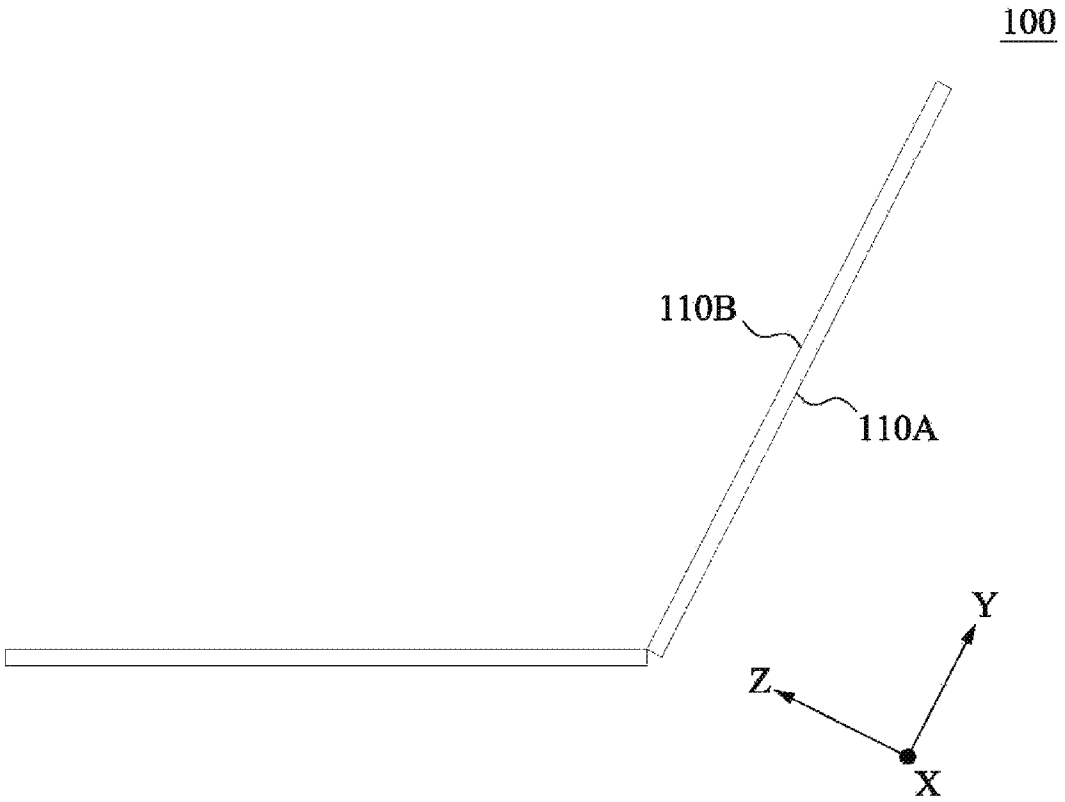
FIG. 1 is a side view of a communication device according to an embodiment of the disclosure.

FIG. 1 is a side view of a communication device according to an embodiment of the disclosure. A communication device 100 includes a metal cover 110A and a display 110B. In an embodiment, the communication device 100 is a notebook computer, a smart phone, or a tablet computer, which is not limited herein. In FIG. 1, the communication device 100 is a notebook computer, a metal cover 110A is a metal casing, and a display 110B is a display panel, which is not limited herein.

Figure 2:
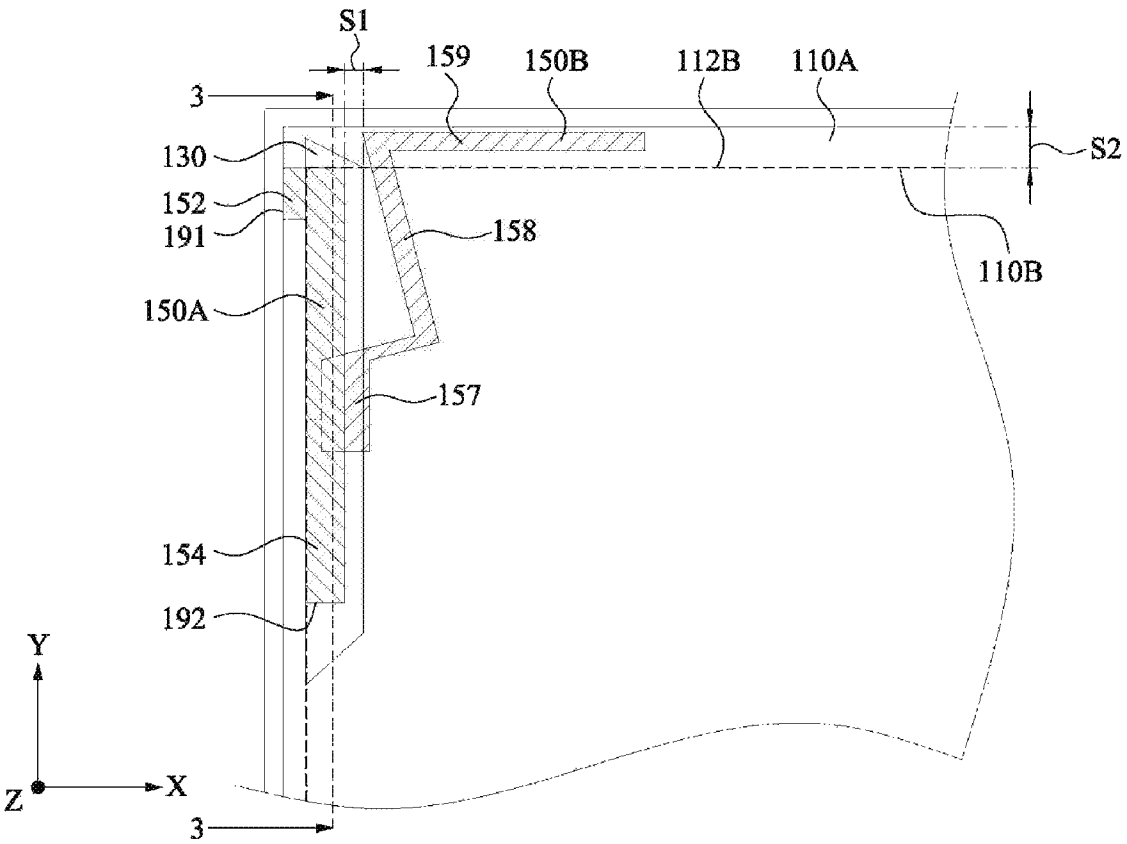
FIG. 2 is a schematic diagram showing a portion of a communication device according to an embodiment of the disclosure.

FIG. 2 is a schematic diagram showing a portion of a communication device according to an embodiment of the disclosure. The communication device 100 includes a first radiator 150A and a second radiator 150B. The metal cover 110A includes a slot 130. The display 110B includes a metal member 112B. In an embodiment, the metal member 112B overlaps the metal back cover 110A at the direction Z. In the embodiment shown in FIG. 2, the slot 130 is ladder-shaped. In an embodiment, the slot 130 shape is irregular or other shapes with different directions, which is not limited herein. The slot 130 does not fully shield the first radiator 150A at the first direction (such as the direction Z). In an embodiment, the slot 130 extends along another direction (such as the direction Y).

As shown in FIG. 2, the slot 130 overlaps the first radiator 150A at the Direction Z. The first radiator 150A does not overlap the metal back cover 110A at the Direction Z. That is, the first radiator 150A is exposed from the slot 130. Part of the second radiator 150B overlaps the metal back cover 110A at the Direction Z.

The second radiator 150B partly overlaps the first radiator 150A at the Direction Z. A portion of the second radiator 150B overlaps the slot 130 at the Direction Z. The other portion of the second radiator 150B overlaps the metal back cover 110A at the Direction Z.

As shown in FIG. 1 and FIG. 2, the display 110B overlaps the metal back cover 110A at the Direction Z. The display 110B overlaps a portion of the first radiator 150A at the Direction Z. The metal member 112B of the display 110B overlaps part of the second radiator 150B at the Direction Z.

The first radiator 150A includes a first sub-section 152 and a second sub-section 154. The second sub-section 154 does not overlap the metal back cover 110A at the Direction Z. The second sub-section 154 overlaps the slot 130 at the Direction Z. The first sub-section 152 overlaps the metal back cover 110A at the Direction Z. The metal member 112B overlaps a portion of the second radiator 150B at the Direction Z. In an embodiment, the first sub-section 152 and the second sub-section 154 of the first radiator 150A overlaps the metal member 112B at the Direction Z.

The second radiator 150B includes a first sub-portion 157, a second sub-portion 158, and a third sub-portion 159. The second sub-portion 158 is between the first sub-portion 157 and the third sub-portion 15. In an embodiment, the first sub-portion 157 overlaps the slot 130 at the Direction Z. The second sub-portion 158 and the third sub-portion 159 overlaps the metal back cover 110A at the Direction Z. In an embodiment, the first sub-portion 157 and the second sub-portion 158 overlaps the display 110B at the Direction Z. The third sub-portion 159 does not overlap the display 110B at the Direction Z.

In an embodiment, the first sub-portion 157 and the second sub-portion 158 overlaps the metal member 112B at the Direction Z. The third sub-portion 159 does not overlap the metal member 112B at the Direction Z. In addition, a portion of the first sub-portion 157 overlaps a portion of the second radiator 150B at the Direction Z. In an embodiment, a portion of the second sub-section 154 overlaps a portion of the first sub-portion 157 at the Direction Z.

In an embodiment, the metal back cover 110A with the slot 130, the first radiator 150A, the second radiator 150B, and the display 110B are stacked in sequence at the Direction Z.

In an embodiment, as shown in FIG. 2, the first sub-section 152 of the first radiator 150A includes a ground end 191. The ground end 191of the first sub-section 152 is connected with the metal back cover 110A. Then, the first radiator 150A and the second radiator 150B are connected to ground.

The second sub-section 154 is connected with the first sub-section 152. The second sub-section 154 and the first sub-section 152 extend along the direction Y. An end of the second sub-section 154 of the first radiator 150A far away from the first sub-section 152 includes a feeding end 192. The first sub-portion 157 of the second radiator 150B is connected with the second sub-section 154. The second sub-portion 158 is connected with the first sub-portion 157. The third sub-portion 159 and the second sub-portion 158 are connected and extend along the direction X.

Figure 3A:
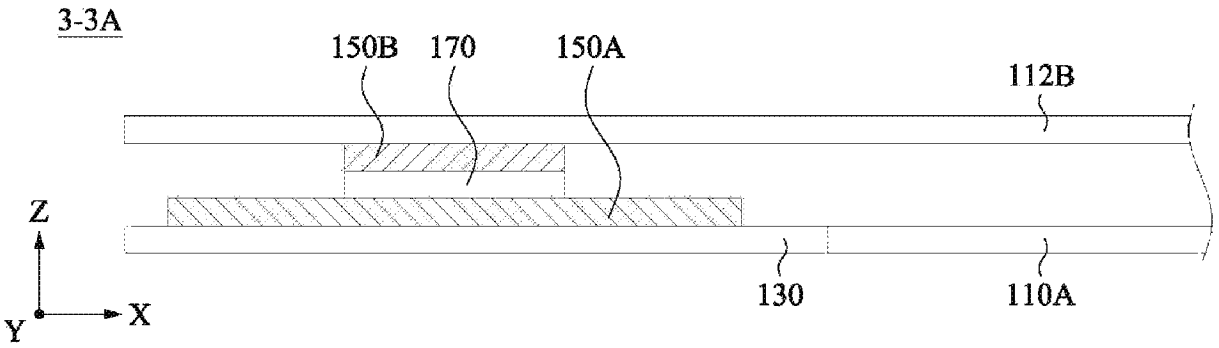
FIG. 3A is a cross section showing a portion of a communication device according to an embodiment of the disclosure.

FIG. 3A is a cross section showing a portion of a communication device according to an embodiment of the disclosure. In FIG. 3A, the cross section 3-3A is an example of the cross section 3-3 in FIG. 2. In FIG. 3A, the first radiator 150A and the second radiator 150B are connected via an isolator 170. In the embodiment, the first radiator 150A and the slot 130 are configured at different planes XY, respectively. The planes XY are perpendicular to the Direction Z.

Figure 3B:
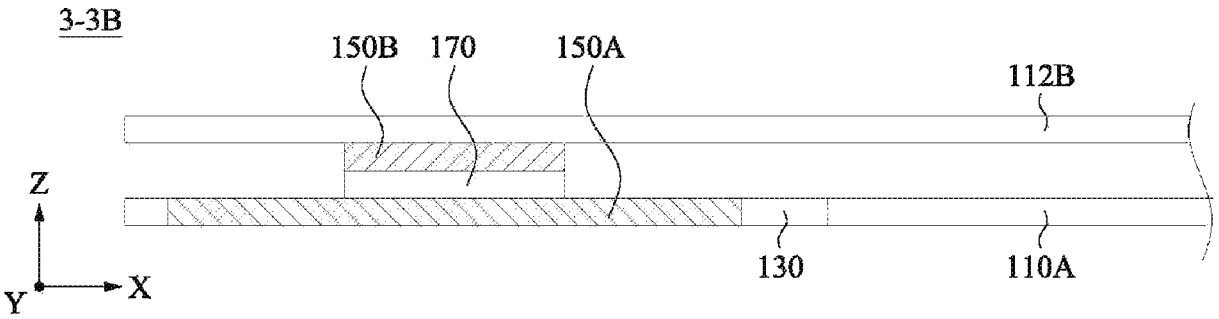
FIG. 3B is a cross section showing a portion of a communication device according to an embodiment of the disclosure.

FIG. 3B is a cross section showing a portion of a communication device according to an embodiment of the disclosure. In FIG. 3B, the cross section 3-3B is another example of the cross section 3-3 in FIG. 2. In the embodiment, the first radiator 150A and the slot 130 are configured at different planes XY, respectively. The first radiator 150A is configured in the slot 130, and then the thickness of the communication device 100 is further reduced.

As shown in FIG. 2, the metal back cover 110A is regarded as a portion of the radiator via a coupling way. In detail, the feeding end 192 of the first radiator 150A feeds energy to the first radiator 150A, the ground end 191 of the first radiator 150A is connected with the metal back cover 110A to connect the first radiator 150A with the metal back cover 110A to form a loop coupling antenna. By adjusting the length of the first radiator 150A, the width of the first radiator 150A, or the gap width S1 between the first radiator 150A and the metal back cover 110A, the operation frequency of the first radiator 150A is adjusted.

In the embodiment, the second radiator 150B is a coupling strip and does not directly connected with the metal back cover 110A. In an embodiment, the amount of coupling is adjusted by adjusting the overlapping area, the overlapping length, and the overlapping width between the first radiator 150A and the second radiator 150B at the Direction Z. Then, the antenna impedance matching and the frequency of the second radiator 150B is adjusted. In an embodiment, the amount of coupling between the first radiator 150A and the second radiator 150B is determined by the overlapping area between the first radiator 150A and the first sub-portion 157 of the second radiator 150B. The operation frequency is adjusted by adjusting the amount of coupling. By adjusting the position of the first sub-portion 157 relating to the slot 130 and the first radiator 150A at the direction Y, good resonance modes (impedance matching) can be effectively excited.

In an embodiment, the distance between the metal back cover 110A and the display 110B at the direction Y is the distance S2.The efficiency of the first radiator 150A and the second radiator 150B is adjusted by adjusting the distance S2. Conventionally, the efficiency of an antenna is affected when the first radiator 150A and the second radiator 150B are shielded by the display 110B. However, in the embodiment, even if the first radiator 150A is fully shielded by the display 110B, the efficiency of an antenna is not affected.

In the embodiment, as shown in FIG. 2, even if portion of the first radiator 150A and the second radiator 150B are shielded by the metal back cover 110A and the display 110B, the first radiator 150A and the second radiator 150B also have good sending-receiving efficiency. In an embodiment, the first radiator 150A operates at the frequency band of 2.4 GHz. In an embodiment, the first radiator 150A is coupled with the second radiator 150B to excite the slot 130 to operate at the frequency band of 5 GHz, which is not limited herein.

Different from conventional antennas, according to communication devices in embodiments, even if the size and the shape of the slot is various, the antenna radiation efficiency is high. In embodiments, the main extending branch of the radiator of the antenna and the metal casing are connected (that is, the antenna is connected with the metal casing) to reduce the influence of the metal cover. The antenna frequency and the impedance matching can be adjusted via the branch of the double path (such as the second sub-portion 158 of the second radiator 150B in an embodiment). Then, even the length and the space of the main path of the antenna are limited, the required frequency band can be adjusted. Furthermore, the shape and the position of the slot can be various, and thus the slot can be adapted to kinds of electronic devices, and the efficiency of the radiator would not be affected.

Terms in specification and claim denote some specific components. However, people skilled in the art also know that the same components also may be named via different terms. As a result, the components should not be differentiated according to the terms, but according to the function. The terms "include", "have" are open-ended. The term "couple" includes direct and indirect connections. For example, if a first component is couple with a second component, that means, the first component is directly and indirectly connected with the second component via electronic connection, wireless transmission, optical transmission, some other components and so on.

The shape, the size, and the relative positions of components in the figures are not used to limit the invention.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A communication device, comprising:

a metal back cover including a slot;

a first radiator, overlapping the slot at a first direction; and a second radiator, a portion of the second radiator overlaps a portion of the first radiator at the first direction, wherein an amount of coupling between the first radiator and the second radiator is determined by an area of the portion of the second radiator overlaps the first radiator at the first direction;

wherein the first radiator comprises a ground end and a feeding end;

wherein the ground end is comprised in a first sub-section of the first radiator and the feeding end is comprised in a second sub-section of the first radiator, and the second sub-section is connected with the first sub-section;

wherein the feeding end feeds energy to the first radiator, and the ground end is connected with the metal back cover;

wherein the first radiator and the second radiator are connected via an isolator.

2. The communication device according to claim 1, wherein the communication device further includes a display, and the slot, the first radiator, the isolator, the second radiator, and the display are stacked in sequence at the first direction.

3. The communication device according to claim 1, wherein the first radiator is exposed from the slot.

4. The communication device according to claim 1, wherein the first radiator and the slot are located at a same plane.

5. The communication device according to claim 1, wherein a portion of the second radiator overlaps the metal back cover at the first direction.

6. The communication device according to claim 2, wherein the display includes a metal member, the metal member overlaps the metal back cover at the first direction, and the metal member overlaps a portion of the second radiator at the first direction.

7. The communication device according to claim 6, wherein the metal member overlaps a portion of the first radiator at the first direction.

8. The communication device according to claim 1, wherein the second radiator includes a first sub-portion, a second sub-portion, and a third sub-portion, the first sub-portion and the slot overlap at the first direction, the second sub-portion and the third sub-portion overlap the metal back cover at the first direction.

9. The communication device according to claim 8, wherein a portion of the first sub-portion overlaps a portion of the first radiator at the first direction.

10. The communication device according to claim 8, wherein the communication device further includes a display, the first sub-portion and the second sub-portion overlap the display at the first direction, the third sub-portion does not overlap the display at the first direction.

* * * * *